US005819349A

United States Patent [19]

Schwartz

[11] Patent Number: 5,819,349

[45] Date of Patent: Oct. 13, 1998

[54] MATTRESS

[76] Inventor: Jack Schwartz, 472 Spadina Road, Suite 1, Toronto, Ontario, Canada, H5P 2W7

[21] Appl. No.: 640,031

[22] Filed: Apr. 29, 1996

Related U.S. Application Data

[63] Continuation-in-part of Ser. No. 197,961, Feb. 17, 1994, Pat. No. 5,513,402.

[30] Foreign Application Priority Data

Aug. 20, 1991 [WO] WIPO ..... PCT/CA91/00295

[51] Int. Cl.[6] ..... A47C 27/15

[52] U.S. Cl. ..... 5/740; 5/722; 5/727; 5/739

[58] Field of Search ..... 5/692, 701, 722, 5/723, 727, 728, 737, 738, 739, 740

[56] References Cited

U.S. PATENT DOCUMENTS

| | | | |
|---|---|---|---|
| 1,276,361 | 8/1918 | Hobert . | |
| 2,154,910 | 4/1939 | Magaril | 5/722 |
| 2,879,523 | 3/1959 | Klassen | 5/352 |
| 3,110,042 | 11/1963 | Slemmons | 5/345 |
| 3,308,492 | 3/1967 | Lovette | 5/352 |
| 3,319,274 | 5/1967 | Upton | 5/722 X |
| 3,512,191 | 5/1970 | Wall | 5/345 |
| 3,521,311 | 7/1970 | Cohen | 5/345 |
| 3,534,417 | 10/1970 | Boyles | 5/345 |
| 3,538,521 | 11/1970 | Basner | 5/91 |
| 3,623,170 | 11/1971 | Staley | 5/90 |
| 3,731,327 | 5/1973 | Frey | 5/345 |
| 3,846,857 | 11/1974 | Weinstock | 5/345 R |
| 3,939,508 | 2/1976 | Hall | 5/345 R |
| 4,168,554 | 9/1979 | Hindes | 5/446 |
| 4,213,214 | 7/1980 | Gilhooly | 5/727 X |
| 4,231,127 | 11/1980 | Bendell | 5/462 |
| 4,365,371 | 12/1982 | Boussaroque | 5/728 |
| 4,706,313 | 11/1987 | Murphy | 5/464 |
| 5,513,402 | 5/1996 | Schwartz | 5/727 X |

FOREIGN PATENT DOCUMENTS

| | | |
|---|---|---|
| 2 590 142 | 5/1987 | France . |
| 1 220 720 | 7/1966 | Germany . |
| 1 940 763 | 1/1971 | Germany . |
| 439 627 | 12/1967 | Switzerland . |
| 1 257 962 | 12/1971 | United Kingdom . |
| WO 81/02384 | 9/1981 | WIPO . |

*Primary Examiner*—Michael F. Trettel
*Attorney, Agent, or Firm*—Darby & Darby

[57] ABSTRACT

The multi-layer mattress provides a separation sheet, for example, made of plastic or cloth, between foam layers to allow them to better flex and compress separately.

19 Claims, 10 Drawing Sheets

MATTRESS

This application is a continuation-in-part application of Ser. No. 08/197,961 filed Feb. 17, 1994, now U.S. Pat. No. 5,513,402, issued May 7, 1996, a continuation-in-part application of PCT/CA92/00348 filed Aug. 11, 1992, now abandoned.

FIELD OF THE INVENTION

This invention is concerned with a mattress or cushion structure and a combination system including the mattress for use on a bed frame which will provide the user, or users, with a choice of mattress firmness without disturbing the overall height of the sleeping surface from the floor.

In the following discussion two terms are used to have meanings somewhat different to those commonly attributed to them.

By a "single" bed, mattress, or the like, is meant a unit of a size commonly used by one person; thus, it can range upwardly from a crib or child's bed, at least to the size known in North America as twin (that is, up to about 1 meter in width and about 1.8 meters in length).

By a "double" bed, mattress, or the like, is meant a unit of a size commonly used by two persons; thus, it can range upwardly from the size known in North America as double (about 1.8 meters in width and about 2.1 meters in length).

BACKGROUND OF THE INVENTION

Generally speaking, the hardness, or firmness, of a conventional bed comprising a mattress supported by a base is determined by the choice of materials made during the construction of each of the mattress and the base. Consequently, beds are available in which the firmness can vary at different points within a particular bed, and in which the overall firmness varies between separate beds. However, the only choice of firmness which a user can make with such a conventional bed or mattress is made when the bed or mattress is purchased. Thereafter, the user has little further choice, other than to replace the item. Choice on purchase is apparently simple, and is usually a matter of trial and error. Generally, the choice is made by sitting or lying briefly on the mattress, for example in a bedding store. This is not an adequate or very reliable test method. A further significant problem can arise if either a need is encountered to change the firmness of an existing bed (either temporarily or permanently), or if two persons using a double bed require radically different firmnesses. For example, one person may require a very firm support for orthopedic reasons, whilst the other may find such a level of firmness uncomfortable to the point that sleep is not possible.

There are also problems of deflection transmission sideways across a bed, especially if one user is of significantly different weight to the other.

This invention seeks to mitigate and to overcome these problems by providing a mattress system in which the firmness can be chosen at will, even on a daily basis, and in which different firmness for each of two users is practical. This invention also seeks to provide a mattress for a single person in which the hardness can be changed, either temporarily or permanently, in response to a perceived need.

Additionally, a mattress according to this invention can be maintained at a given level of firmness on an on-going basis over a period of time. Consequently, such a mattress is not subject to the loss of firmness encountered with a conventional mattress after an extended period of use. Further, this invention seeks to provide a mattress for two people which permits each person to select a desired level of firmness, and also to be able to change each persons' part of the mattress, either permanently or temporarily, in response to a perceived need. Furthermore, this aspect of the invention also seeks to provide a mattress for two people in which the top surface is always at the same height across its full width, regardless of the firmness selected, in which there is a smooth transition from one part of the mattress to the other, and also no significant intervening gap.

It is known that by using various combinations of the currently available elastomeric foam materials (in the past, these were either natural or synthetic rubber; in more modern practice, polyurethanes are used), a level of variation of firmness can be obtained. Thus Hood, in U.S. Pat. No. 3,118,153 describes an upholstery construction wherein corners are strengthened by using two layers of soft foam with a layer of harder foam in between them. Boyles, U.S. Pat. No. 3,534,417 applies similar concepts to a mattress, to provide some level of choice. A different level of firmness is obtained by turning over either the whole mattress, or an intermediate portion thereof extending across the full width of the bed. All of the mattress portions are enclosed within a common casing. Whilst this does give a flat sleeping surface, only a very limited number of choices of firmness are provided.

Johnson, U.S. Pat. No. 2,121,339 describes a more complicated system. The mattress consists of two layers of foam of differing firmness with a hard board layer in between them. The firmness is changed by reversing the elements making up the mattress. Thus, although a constant thickness results, few choices of firmness are allowed. For a double bed, it appears that the whole surface would have to have the same firmness. A similar mattress utilizing two layers of dissimilar foam is described by Slemmons, U.S. Pat. No. 3,110,442. In this mattress, two stacked resilient members are used of different firmness, with a provision to insert firming slats, either at predetermined points, or more or less anywhere, across the width of the mattress. A mattress using a plurality of encased foam pad elements is described by Betten-Zellekens in German 1,940,763. This mattress is somewhat similar to that described by Slemmons, in that a stiff, preferably plywood, panel is included into the stack. Thus, although a plurality of foam elements is used, the only way to adjust the firmness is to reposition the plywood insert within the stack.

It has now been realized that a mattress can be provided which both provides a uniform and constant sleeping surface height at substantially the same level as a conventional bed, and yet which provides the, or each, user with a high degree of choice of firmness.

SUMMARY OF THE INVENTION

According to the invention, there is provided a multi-layer cushion or mattress comprising at least two foam mattress elements having a same or different hardness with respect to each other, and separation means for permitting each of the mattress elements to compress and flex separately when stacked one above the other. In this specification, mattress and multi-layer mattress are terms which include seat cushions, upholstery cushions and pillow cushions.

The invention also provides a mattress comprising a first foam mattress having a given hardness and at least one lengthwise edge modulator panel of a different hardness foam, the panel bordering between two sleeping zones, and a second mattress having a hardness other than the given hardness of the first foam mattress and being adjacent the modulator panel. The different hardness foam is selected to permit a firmness of the first foam mattress at the lengthwise edge to substantially match the hardness of the second mattress at a corresponding edge thereof. The modulator panel can comprise a softer foam than the mattress element or a firmer foam, the object being to provide a combination which yield a firmness suitable for a good transition between the two zones.

According to the invention, there is also provided a mattress comprising a first foam mattress, edge separation means provided on a longitudinal side edge of the first mattress, and a second mattress longitudinally adjacent the first mattress. The edge separation means allows the first mattress to compress and move vertically with reduced friction while in contact with said second mattress.

The invention also provides a multi-layer mattress comprising at least two foam mattress elements, at least one of which having a different hardness from the others, the elements being arranged in a stack one above the other. The elements have at least a portion of their contact surfaces between each other and between a support base exposed so as to allow friction due to the exposed portion to hold the stack in alignment.

According to a further aspect of the invention, there is provided a multi-layer mattress comprising at least two mattress elements, at least one of which being made of foam, open top containment means adapted and constructed to ensure that the mattress elements remain situated in their chosen order in a substantially vertical stack, and to subject the mattress elements to slight lateral compression, the containment means allowing the elements to be removed from the stack vertically, and edge separation means for allowing the elements to flex and move vertically with reduced friction between the elements and the containment means.

Thus, in one of its broadest aspects, this invention provides a mattress comprising a plurality of foam mattress elements, which themselves provide a significant range of choices of firmness to the, or each, user. To this can be added a higher level of firmness, either over a partial area of the mattress by means of the torso board, or over substantially the whole area of the mattress by means of the rigid core element. If deemed desirable, both a torso board and a core element could be used together. Additionally, all of these choices are available to the, or each, user of the mattress. In the case of a double bed, if these choices are exercised in the manner set forth below, a substantially constant top sheet height is maintained. Thus, although the two halves of a double bed may have remarkably different properties, the bed coverings present a flat top surface.

The mattress system according to the present invention comprises a series of mats and additional elements which combine to form a mattress. The conditions of the mattress are influenced and determined by vertical and horizontal location of these components. The conditions of the mattress are further influenced by the manner in which the mats interface and interact with each other. Preferably, the mats are of a variety of compressions. Preferably, the mats are of a certain and similar thinness. The more mats in the system, the more variety of conditions. The thinner the mats the more precision possible for fine tuning. It is preferable to limit overall thickness within standard mattress heights. This permits application of standard bed clothes.

This multilayer mattress system employs a preferably coefficient separation means in between and at the edge of the mattress elements. The separation conditions apply to this mattress system in ways which do not apply within the prior art. The application of the separation means within this mattress system provides novel advantageous function and performance not possible and/or not applicable within the prior art.

The separation means facilitates the arrangement and rearrangement of the elements in the mattress which form its conditions. These conditions include degree of surface firmness, degree of surface contouring, degree of surface softness, degrees of underlying firmness and support, locations for support vertically and horizontally.

The separation means enables the user to arrange and rearrange the mattress elements conveniently. This allows the user to develop the desired mattress conditions by direct choice and/or experimentation. Assuming six mattress layers and a double occupancy bed, there are thousands of different conditions which the user may form providing variety and fine tuning not otherwise possible. When factoring in the possible locations of the torso board in height and laterally plus the core element in height, the possibilities are incalculable. There are various reasons for changing the conditions of the mattress beyond mere preference of the user, some examples are change of user, i.e. hotel, hospital, guest room, change of time period in bed, injury, sensitive points, points requiring support, pregnancy, change of weight, back problems and wear of the mattress. The thinness and resulting minimal weight of the mats renders this system practical to the operations of arrangement and rearrangement.

The separation means facilitates squaring the mats one upon the other; this operation is extremely difficult without benefit of the separation means. A foam to foam condition will result in sticking together to the point of entirely frustrating lateral adjustment.

The separation means allows mats and the core element to be removed from the center of the stack and placed into the center of the stack. These operations are virtually impossible without the separation means. Furthermore, attempting these operations without the separation means will result in tearing of the mats including tearing out chunks of foam.

The separation means facilitates the removal, insertion of the torso board within the stack at the desired height as well as locating the torso board at the preferred location laterally.

The separation means avoids foam to foam friction which results in powdering and overall deterioration. Simply lying and moving on top of the mattress will cause powdering and deterioration to the overall multilayered stack.

The separation means avoids foam to foam inhibition, it thereby allows each mat its pure independent behavior. A foam mat will be restricted from its natural and complete response when stuck to another foam mat, particularly when sandwiched, and considering the thinness of the foam in this system. The interfacing of foam mats is a factorial consideration in developing the desired conditions, achievable in this mattress system, for example, a soft foam will be more responsive in its absorption quality if it is allowed freedom of complete flexibility. This absorption will be reduced if the mat is stuck to and therefore restricted by other foams. It will also assume a modicum of the characteristic of the foam to which it is adhering, i.e. a hard foam will have a penetrating firming influence on a soft foam if the two are stuck together. In the case of a hard foam on top of a soft foam, the desired effect is to provide firmness combined with shock type absorption and/or a bounce effect. If the mattress elements are stuck together, the restriction will reduce the absorption and bounce qualities of the combination. In order to optimize the outcome of the overall mattress conditions desired, each foam mat element should be enabled to provide its maximum intended contribution by flexing and responding freely.

The separation means can also be used to improve air flow between mats, because when mats do not stick together, air may pass between the mats. Mats so separated will deform from each other when the user moves, further enhancing air flow. The air circulation provides freshness, dryness and coolness to the surface of the mattress for the ultimate comfort of the user. The cooling and freshening of the overall mattress will maintain same in better condition and increase longevity.

The separation means increases tensile strength of the mats, particularly crucial in this mattress system which may involve a great deal of handling and movement of the mats in the arranging and rearranging of the mats. This is of particular significance when considering the thinness of the mats in the system.

The edge separation means according to the present invention avoids friction and snagging, enabling side by side mats to remain level to each other. The thinness of the mats are a factor in this requirement. The avoidance of friction and snagging at the meeting line of two adjacent mattresses also prevents disturbance of the adjacent mattress user.

The separation means increases the longevity of the mattress as compared to existing mattresses. Mattresses are most susceptible to wear and fatigue at their top surface. This is the case in foam surfaces. Foam is presently applied at the surface of the vast majority of mattresses of all types. It is a well known fact that turning over a mattress periodically will extend its life. This practice is recommended by virtually all mattress manufacturers. It is based primarily on the recovery principal. The separation means employed in this mattress system which enables convenient rotation of the mattress elements and where each mattress comprises a multiple of mattress elements, the longevity factor is extended accordingly. For example, six mattress elements would provide twelve top surfaces as compared to two top surfaces in existing mattresses. Having increased the top surfaces by ten, results in a direct increase of six times the top surface longevity. If the surface integrity of a two surface mattress would on average be five years, this would mean extension to approximately thirty years, which represents a significant improvement. The longevity would be further enhanced by the recovery principal advantage as recovery time would be greatly increased. Additionally, the individual mattress elements are smaller, lighter and therefore easier to turn.

The separation means enables each mattress element to spring freely and fully. This increases the desired spring and bounce "feel" so desirable in a mattress for purposes of comfort and shock absorbency.

The separation means provides reinforcement support to the mattress elements at various intervals thereby increasing the overall strength, quality and shape maintenance.

The edge separation means allows the mattress elements to interact coefficiently within the containment means and including for placement and removal operations.

Alternatively, the preferred form of foam mattress element, used in the mattress sets, itself, when used alone as a mattress, presents improved properties over the commonly used simple foam slab mattress.

Preferably, the plurality of foam mattress elements comprises a set of foam mattress elements, several of which have a different degree of firmness.

Preferably, at least one foam mattress element includes at least one lengthwise modulator panel, of medium hardness foam.

Preferably, in a mattress or mattress element including modulator panels, the panels have a wedge-shaped cross-section, and are attached to a corresponding beveled edge of the mattress or mattress element.

Preferably, the rigid core element has a layer of foam on its upper surface and a layer of foam on its lower surface, and most preferably, the upper and lower layers of foam are of different firmness.

Preferably, the mattress elements comprising a single bed include one rigid core element, or one torso board, or both.

Preferably, the mattress elements comprising a double bed include two sets of foam mattress elements, each about half the width of the bed; with which may be combined one or two rigid core elements each about half the width of the bed, and if desired, one or two torso boards.

Preferably, a torso board is used alone, or separately for the, or each, user of the mattress.

Additionally, a torso board may be used in combination with a rigid core element, preferably placed above the core element and separated from it by at least one mattress element.

Preferably, the separation means comprises at least one layer of fabric associated with at least one face, of two contacting faces, of the mattress elements, a core element, and a torso board, if present.

Preferably, the containment means comprises a fitted sheet means, which may further include both an additional lower surface, and openable closure means to enable laundering. Preferably, the containment means includes a cradle means adapted to retain, and to ensure constant lateral pressure upon the mattress elements.

In a further preferred alternative combination, both a fitted sheet and a cradle are used as the containment. If a cradle is used, a flat sheet tucked-in can also be used, rather than a fitted one.

Thus, for a double bed, the containment means can comprise one fitted sheet means which contains the two sets of mattress elements. In a further option, the containment means can comprise in combination a first and a second fitted sheet means each containing one set of mattress elements together with a third fitted sheet means containing the two sets of mattress elements encased in the first and the second fitted sheet means. For each of these options, the assembled mattress can also be contained in a cradle means.

BRIEF DESCRIPTION OF THE DRAWINGS

The invention will now be described by way of reference to the attached Figures, in which.

DETAILED DESCRIPTION OF THE PREFERRED EMBODIMENTS

Figure 1:
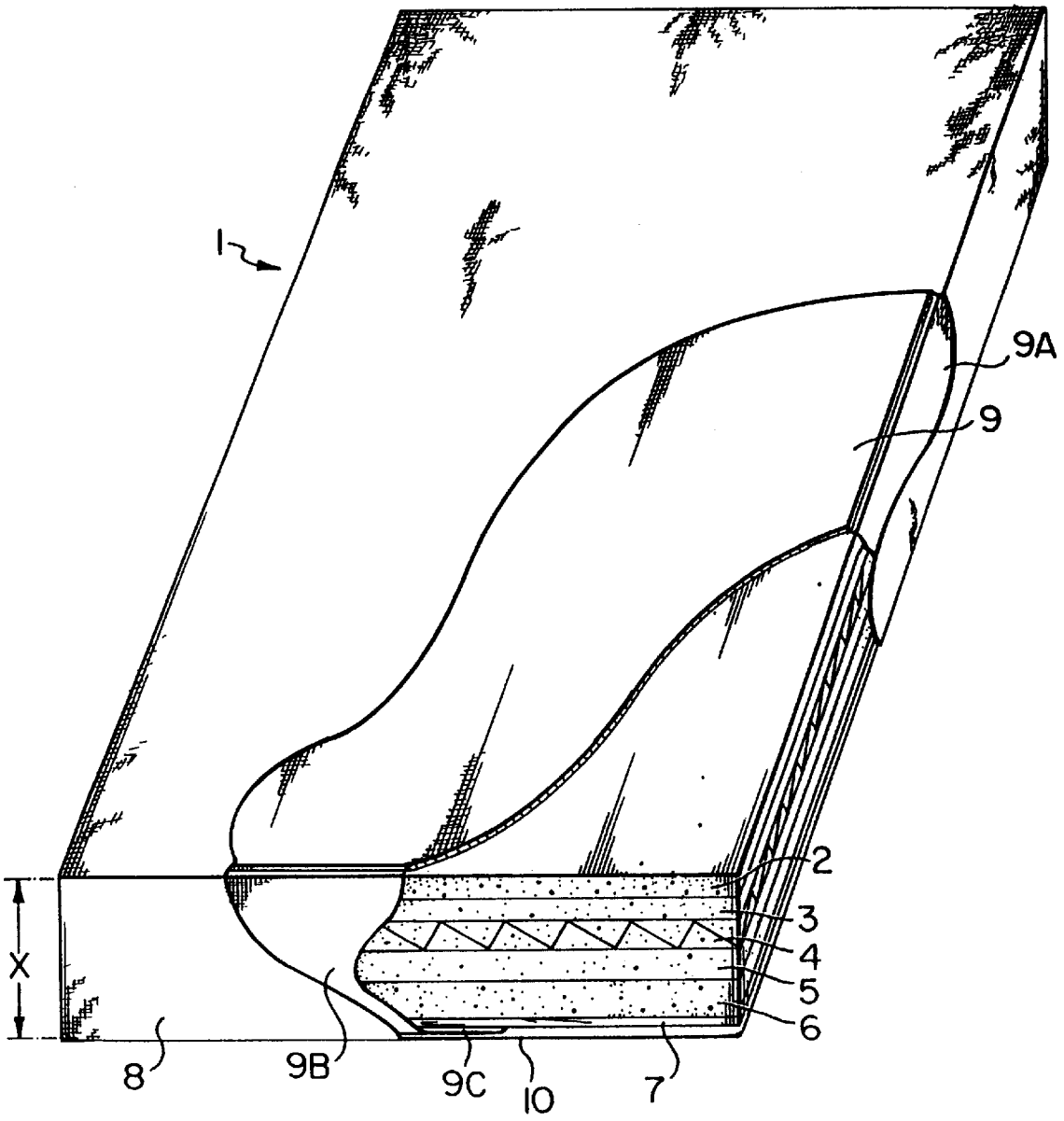
FIG. 1 shows a single mattress, partly sectioned.

In FIG. 1 is shown perhaps the simplest form of construction for a mattress according to this invention. The mattress shown generally as 1 consists of five foam mattress elements 2, 3, 4, 5, and 6, which are sized to be a snug fit into the containment means 8 which ensures some constant lateral pressure on all the mattress elements. The elements can be rearranged in order to alter the hardness of the sleeping surface, since at least one of them, for example 4, has a different hardness to the others. This aspect of this invention will be discussed further, below. In FIG. 1, the containment 8 is a fitted sheet but, as discussed in detail later, other methods may also be used. In practice, the overall thickness of the group of foam mattress elements is chosen so that the overall vertical thickness, as at X in FIG. 1, is substantially the same as that of a conventional mattress. Hence, the containment means 8 comprising a fitted sheet can be a conventional, readily available, ordinary fitted sheet.

Two further optional features of this invention are shown in FIG. 1. At the bottom of the set, there is present a rigid core element 7, the construction of which is discussed below. As shown, it is at the bottom, but it can be placed anywhere in the set, including at the top, if a very hard surface is needed. At the top of the stack, within the fitted sheet 8, there is shown (partly cut away for clarity) a mattress pad 9. Generally this pad—which is commonly used on top of a conventional mattress—is a layer of cotton (or synthetic) wool batt, about 1 cm. thick, and is contained in a fabric cover. The mattress cover, if used, both adds to the overall comfort of the bed, and serves to protect the mattress elements from soiling. Commercially available mattress covers are commonly attached in much the same way as a fitted sheet, as at 9A and 9B.

As shown in FIG. 1, the fitted sheet includes a bottom retaining portion 10. The mattress pad 9, when it incorporates the retaining parts 9A and 9B, will also include a bottom portion 9C. This provides some choice as to which of these will provide the containment means. If it is chosen to make use of the mattress pad assembly as the containment, then the sides 9A, 9B and bottom 9C are so sized as to place the mattress elements under the required slight lateral compression. In that case, it is convenient to have the bottom portion 9C extend over the full area of the mattress; it is also then necessary to provide a closure, such as a zipper, so that the containment can be opened in order to change the sequence in the stack. The sheet 8 can then be an ordinary commercial fitted sheet, or it may even be a flat sheet tucked-in, although a fitted sheet is preferred.

Alternatively, the mattress pad need not provide the containment, which can be provided by the sheet alone, in which case the sheet bottom portion 10 preferably extends over the full area of the mattress, and a closure, such as a zipper, is needed. In a third option, both the sheet 10 and mattress pad assembly 9, 9A, 9B, and 9C can contribute to the containment means.

As can be appreciated, when the foam mattress elements 2, 3, 4, 5 and 6 have the same firmness or hardness of foam, the positioning of the torso board and core element still provide an ability to adjust the firmness of the multi-layer mattress while allowing the individual mattress elements to compress and flex independently. The separation means also facilitate the sliding in and out of the torso board if it is used. After sliding the torso board in or out, the separation means enables the mattress elements to return to squared and flat conditions. Should the mattress elements deform during usage of the mattress, the separation means will enable the mattress elements to reform to their original state.

A further feature of FIG. 1 should also be noted. It can be seen that the mattress elements 2, 3, 4, 5, and 6 are not all the same thickness. Hence, the overall firmness in such an arrangement is a function of both the firmness of the foam used in each separate mattress element, and the thickness of each element. A thick, firm element will have more effect than a thin one. For a single bed, variation in mattress element thickness presents no difficulties, since regardless of the sequence, the set is always the same height. However, for a double bed, problems might arise if the bed uses two sets of mattress elements. Interchanging elements between the sets could result in the two sets having different overall heights, which is inconvenient. It is therefore preferred, at least for a double bed, that all of the foam mattress elements be of essentially the same thickness.

The construction of each of the mattress elements is discussed in more detail below.

Figure 2:
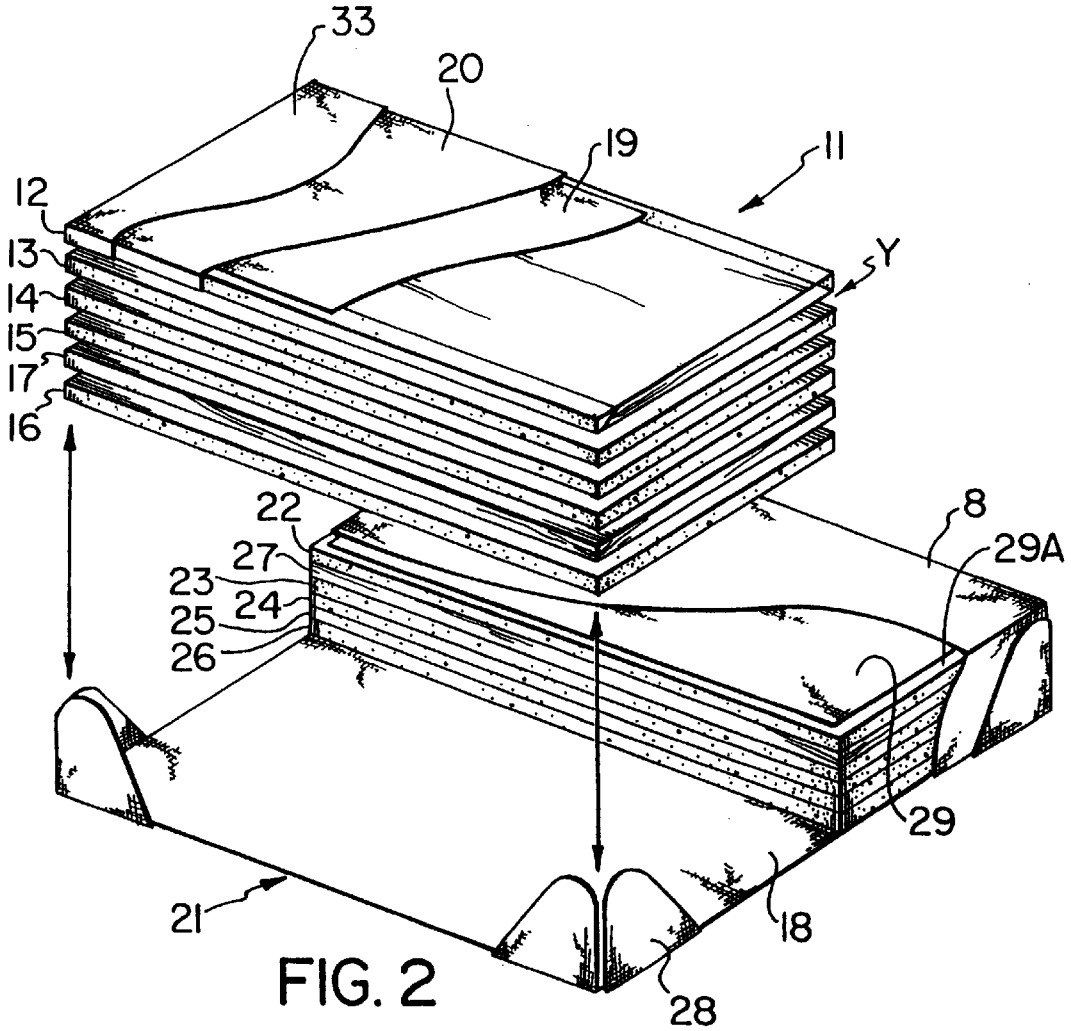
FIG. 2 shows a double mattress and a cradle.

In FIG. 2, a more complex arrangement is shown representing a double bed mattress. The mattress shown generally at 11 comprises two sets of mattress elements 12, 13, 14, 15, 16, and 22, 23, 24, 25, and 26, and two rigid core elements 17 and 27. As shown, these are not in the same place. When both sets are assembled into the cradle 21 with the overall fitted sheet 8 (shown cut away for clarity), the top surface of the sheet 8 is substantially flat.

FIG. 2 also shows some further details concerning various options in the separation means and the containment means.

The purpose of the separation means is to allow each foam mattress element to compress and to flex under the load imposed by the user. If no separation is provided, it appears that foam-to-foam friction relatively rapidly degrades the foam elements, especially in the main load areas, which are usually substantially along the center of the mattress. To eliminate this friction and to ensure that the mattress elements are free to compress and to flex independently, the simple way is to encase each mattress element, the core element, and a torso board, as discussed below, in an individual fabric case, as at 20 for the element 12. A mattress pad as at 19 can be provided within such a case, or it can be incorporated into the case. If such a pad is used, it is preferred that it is included on both sides of the mattress, thus avoiding the mattress elements becoming one-sided. Alternatively, the separation means can comprise a sheet of fabric as at 29 glued or otherwise attached to at least one face of each mattress element, to the core element, and, if required, to a torso board. Again, to avoid the elements becoming one-sided, it is preferred to provide such a sheet on both faces of each mattress element, of the core element, and of the torso board. If such an attached sheet is used, it need not be the full size of the mattress, and an edge border as at 29A, can be left uncovered. It appears that leaving this edge area open to foam-to-foam friction is beneficial, particularly in a double bed having two mattress sets, as it helps in eliminating any separation between the two sets along the mattress centerline. Further, it is also possible to include a mattress pad, as at 19, either with and as part of the sheet 29, or in conjunction with it, so that the pad is somewhat smaller than the mattress element with which it is associated. In that case, it has been found beneficial to provide a shallow recess in the mattress element to receive the pad, so that the mattress element retains an essentially flat surface.

The separation means may comprise a single sheet of material provided between two foam elements provided that the sheet has a sufficiently low coefficient of friction with the foam to allow the foam surface to move with respect to the sheet. Certain plastic sheets provide a suitable reduced friction with conventional bedding foam. In the preferred embodiment, a fabric covering on each foam surface where there is to be separation works well because each fabric sheet adheres to its respective foam element with reduced friction between the sheets.

For such a double bed, it is also possible to use one, or more, mattress elements which are the full size of the bed.

There are several choices for the containment for a double bed, which are much the same as those discussed above for FIG. 1. If a cradle is used, as is discussed below, then the overall sheet 8 may be omitted, and each mattress contained in its own sheet, as at 33 on the element 12.

It is also possible to include a mattress pad into the separation means, especially when this is an attached sheet, such as 29 in FIG. 2.

Figure 3:
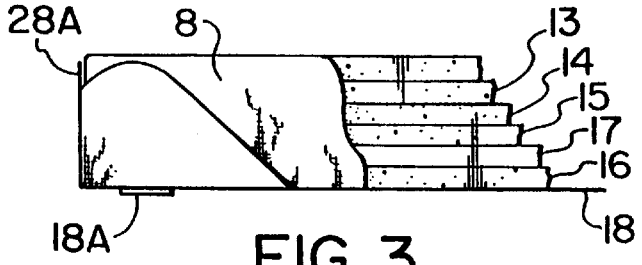
FIG. 3 shows a detail of the cradle.

The containment means, in addition to the overall fitted sheet 8, and the pad 9, may include a cradle. One possible cradle arrangement, 21, shown in FIGS. 2, 3, and 9, comprises a base 18, and corner elements 28. These corners include a flex niche 28A allowing the corner to deflect, for example, when sat upon, as can be seen from FIG. 3. The corners 28 are so spaced that when all of the mattress elements are stacked into the cradle, the two sets will be under some slight lateral compression, in addition to any provided by a fitted sheet, such as 8. As a consequence of the lateral compression, the corner elements also serve to substantially eliminate centerline separation. If a cradle is used, as is preferred for a double bed, then although a sheet will be needed usually, it does not have to be a fitted one forming part of the containment.

The manner of construction of the cradle depends upon the nature of the base to be used underneath it. If it is to be used on top of an existing box spring base to replace an existing mattress, then the base 18 of the cradle can be relatively light material, for example the 3 mm. thick hardboard known as masonite, and perhaps need not be continuous covering the whole area of the bed. It is also advantageous to provide some anchoring of the cradle 18 to a box spring base. Conveniently, this can be done by the use of cooperating hook and loop type fastener patches (e.g. Velcro brand), as at 18A in FIG. 3. Alternatively, if the cradle is to be placed on a base, which provides adequate support only at the edges together with one or two cross-beams, such as a steel bed frame, then a much heavier material for the base 18 will be needed. For example, for a single bed it could be a sheet of 20 mm. plywood of suitable size.

Figure 4:
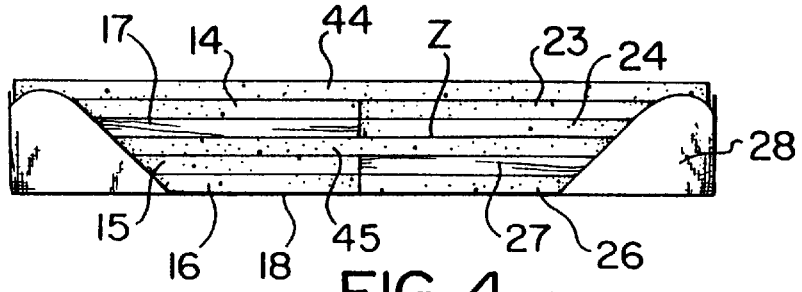
FIG. 4 shows a mattress set for a double bed.

As shown, the double bed of FIG. 2 uses two sets of mattress elements. This is not necessary, as a perfectly usable bed can be made in the same way as in FIG. 1, by using adequately sized elements. However, in such an arrangement, individual choice for each user is lost. Alternatively, a mix of full width and half width mattress elements could be used, but again, the level of personal choice is diminished, as shown in FIG. 4. In FIG. 4 an end view is shown much the same as FIG. 3, from which the containment, such as 8 in FIG. 2, is omitted for clarity. The double bed mattress can be seen to be assembled from three sets of mattress elements, as follows:

(i) a first group of one person wide elements 14, 15, 16 and 17, in which the core element 17 is roughly midway; (ii) a second group of one person wide elements 23, 24, 26 and 27, in which the core element 27 is near the bottom; and (iii) two full width elements 44 and 45, one at the top and the other lower down.

Thus, the firmness of each of the user surfaces will depend to a degree on the firmnesses of the elements 44, 45 and the order in which both they and the remaining elements are assembled.

In FIGS. 5, 6, 7, and 8 various methods of construction for each of the foam mattress elements are shown. It is in the various available choices for each of the foam mattresses making up a set that the flexibility to choose and to vary the firmness of the overall assemblage is to be found. Each mattress can differ as to its overall firmness, the inclusion of modulator side panels, and head and foot comfort panels.

An interesting feature in this invention is that a mattress element including modulator panels is useful of itself, either as an additional overlay upon a conventional mattress, or if thick enough as a foam mattress.

In foam mattress construction, the inherent "firmness" of the foam material used is important. Unfortunately, commercial foam makers do not have a uniform standard used in describing this attribute of a given foam. The following information is given as a guide to the various levels of firmness used.

TABLE 1

| Foam Characteristic (1) | Compression (2) |
|---|---|
| VS Very Soft | 1.82 |
| S Soft | 2.27 |
| M Medium | 22.7 |
| H Hard | 27.3 |

(1) VS, S, and M are open cell foams; H may be open or closed cell foam.
(2) The compression is measured by determining the weight, in kg, required to compress a 305 mm square piece of foam from a thickness of 102 mm down to 76 mm; hence, a hard, stiff, foam has a high compression, and a soft foam, a low compression.

Whilst often quoted, foam density is not overly important, as it is not directly related to foam firmness. Generally, foams with a density of greater than 32 kg/cubic meter are used. Density is more an indication of foam quality and longevity, as low density foams are generally structurally weaker materials. These tend to fail under repeated compression. A higher density foam is generally more resilient to impact, is structurally stronger, and retains its properties better.

In the drawings of FIGS. 5 through 9 both the casing, shown as 20 in FIG. 2, and any mattress pads, such as 19 or 29 in FIG. 2, are omitted for clarity. In use, each foam mattress element is provided with a separation means, as described above.

Figure 5:
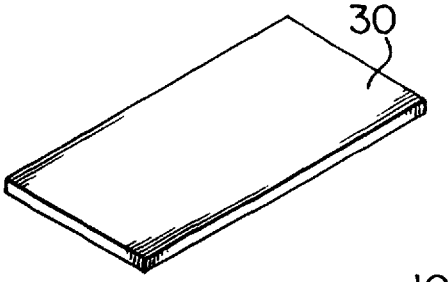
FIGS. 5, 6, 7, 8, 9, and 10 show details of mattress element construction.

The simplest form of foam mattress element, which is suitable for a single bed but has certain disadvantages in a double bed, is shown in FIG. 5 and comprises a simple foam slab 30 of the correct length, width, and thickness. For all of the mattress elements (single or double) the length and width are chosen to fit the bed in question. The thickness is a separate variable. We prefer that there are at least three, preferably five, possibly six, and perhaps even seven, separate mattress elements. Thus, the five mattress elements, plus the core element, preferably will have a total thickness that fits a standard commercial sheet, and is equivalent to a normal mattress. In North America, as this thickness is commonly 15 to 20 cm, each foam mattress is thus of the order of 3 cm thick. As is discussed above, it is preferred that all of the foam mattress elements should be of the same thickness, at least for a double bed.

Figure 6:
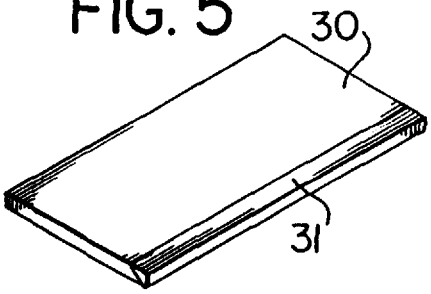
Figure 7:
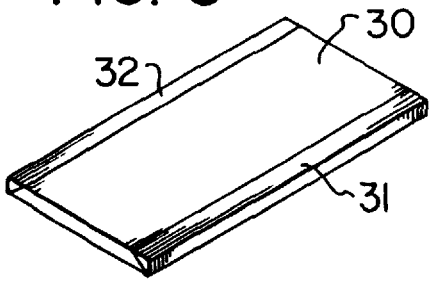
Figure 8:
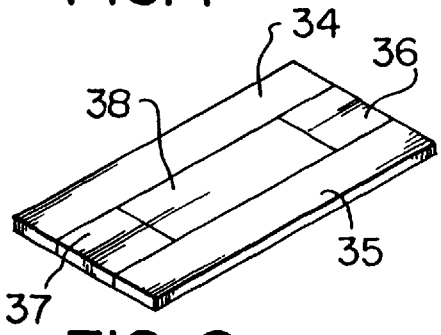
Figure 9:
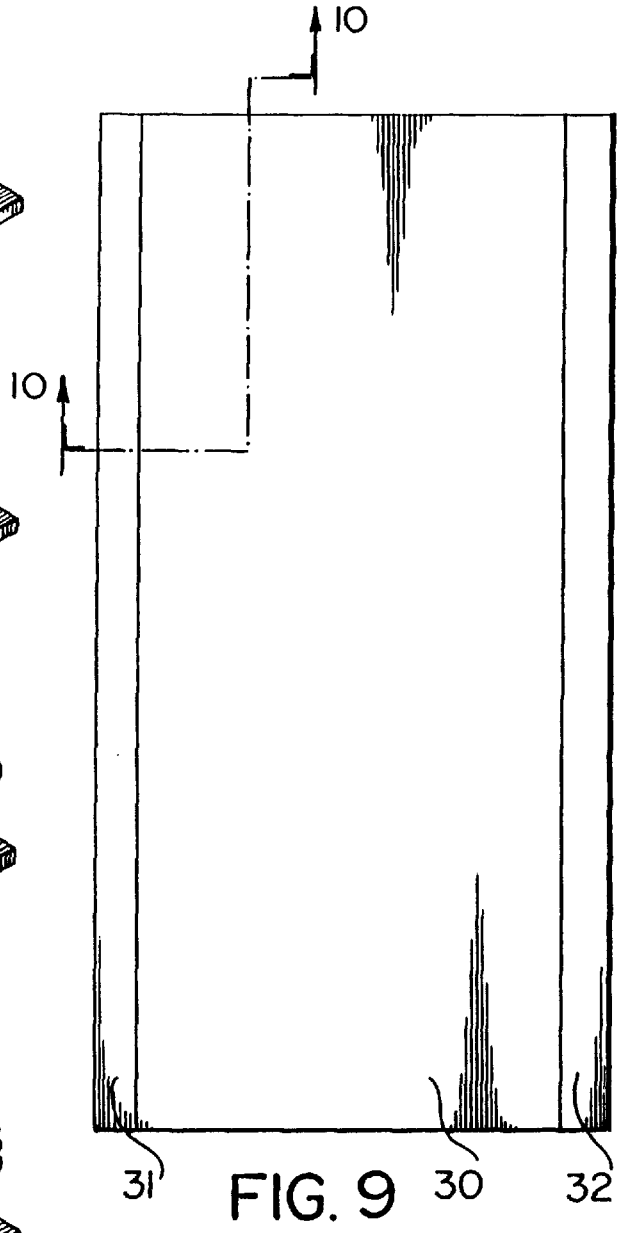
Figure 10:
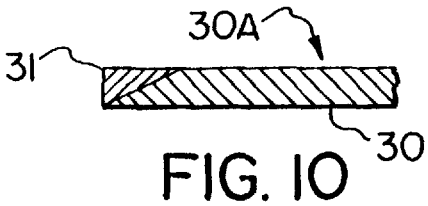
Figure 12:
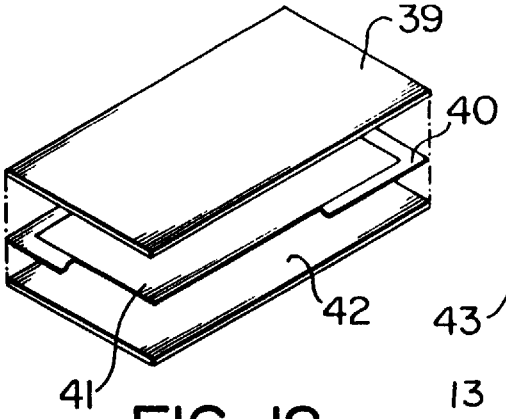
FIGS. 11, 12, 13, and 14 show details of core element construction.
Figure 11:
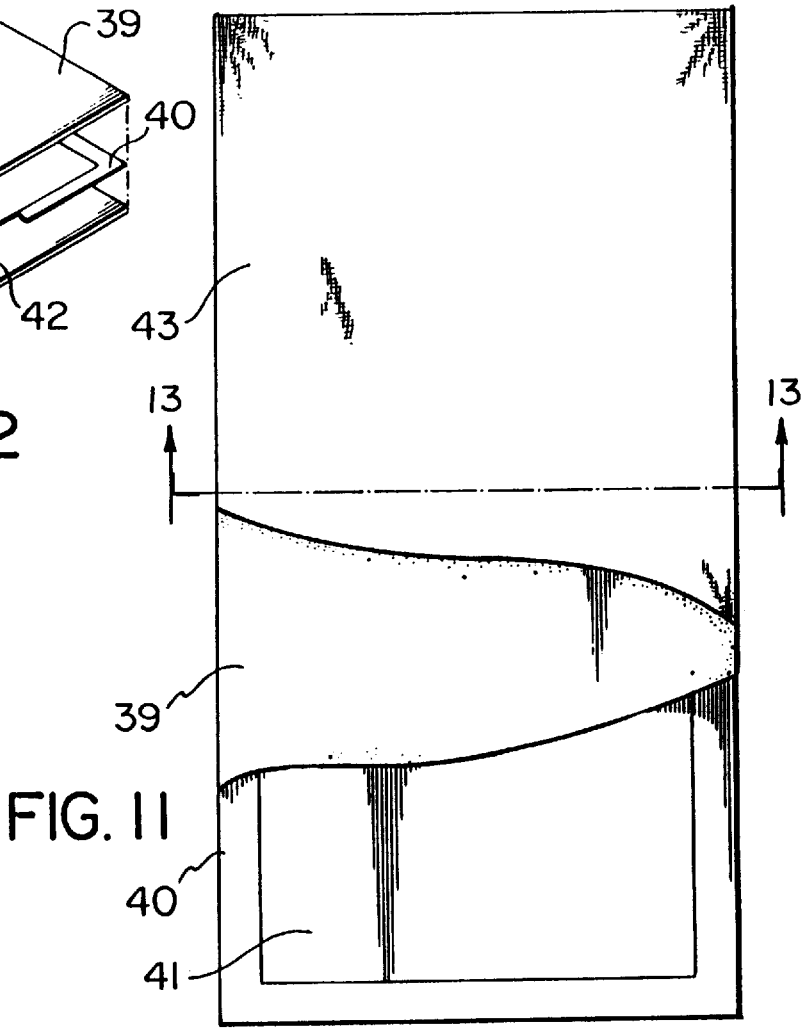

In FIGS. 6 through 10 more complex constructions are shown. FIG. 6 shows an element including a single modulator side panel 31 on one side of the main part 30 of the mattress, and FIG. 7 shows two such modulator panels 31 and 32. As can be seen from FIG. 9 which shows the top face of the mattress of FIG. 7, the modulator panels 31 and 32 extend for the full length of the mattress. The part section in FIG. 10, on the line A in FIG. 9, shows that these panels are tapered inwardly toward the center of the mattress, and the outer edge of the main part of the mattress has a corresponding beveled face.

The modulator panels are usually made from a medium foam. They serve in a single bed to provide an area of edge stiffness. In a double bed, the modulator panels, in addition to providing an area of edge stiffness, serve several other functions, most of which are as a result of the wedge-shaped cross section used (see FIG. 10). They help to minimize variation vertically in two sets of mattress elements in a side-by-side relationship under compression due to body weight. They help to provide a smooth transition from the central area of each mattress element to the edge areas, thus avoiding an abrupt change. They help minimize sheet height variation on the center line, for example when two users are of significantly different weights. This last is impossible with a conventional mattress.

As the modulator panels are usually made of medium foam, they are often not used with a medium foam mattress element, as in FIG. 5. If only one modulator is present, as in FIG. 6, this would be used in a double bed, with the modulator panel at the center of the bed. Generally it is more convenient to include two modulator side panels 31 and 32.

FIG. 8 shows a more complex five part mat mainly useful as the top mattress element in the set. The center panel 38 is chosen to be the desired hardness. The two side panels 34, 35, which can also be tapered as in FIG. 10, serve as modulator panels. In this case, the side panels 34, 35 generally are wider than the modulator panels. The two insert panels 36 and 37 are head and foot comfort panels. For example, 33 will be a relatively hard foam, 34 and 35 both medium foam, and 36 and 37 a soft foam, but other combinations are contemplated.

When used as a mattress on its own, and not as part of a set, the construction of FIGS. 7 and 8 offers significant advantages over a simple foam slab, as is commonly used.

Figure 13:
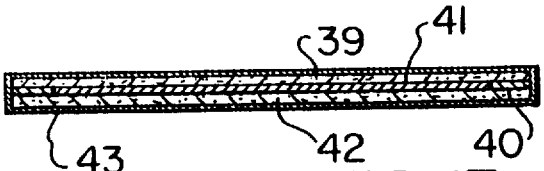
Figure 14:
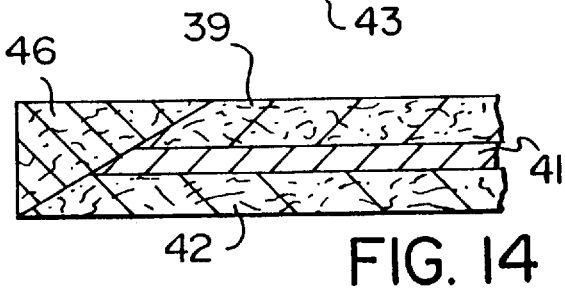

FIGS. 11, 12, 13 and 14 show the construction of the rigid core element, such as 17 and 27 in FIG. 2. The core element is shown in part cut away plan in FIG. 11, as an exploded diagram in FIG. 12, and sectioned along the line B in FIG. 13. An alternative partial section corresponding to the section in FIG. 13 is shown in FIG. 14. The core element comprises a top first cushion layer of foam 39, edge foam panels 40, a central stiff core 41, and a second cushion layer of foam 42. The central stiff core is suitably lightweight compressed board, such as 3 mm hardboard (Masonite). Alternatively a suitably stiff plastics board, such as ABS, could be used. The edge foam panels 40 serve as a cushion to soften the edge of the element, and also in the same way as the modulator panels described above. The two foam cushion layers 39 and 42 provide a level of softness in use. Preferably, in these layers the upper layer is of a medium foam, and the lower layer is a relatively soft foam, and, as shown in FIG. 13, one may be thicker than the other, thus providing two different levels of cushioning. Preferably, the core element is also encased in its own suitable fabric casing, 43. In FIG. 13 the edge foam panels 40 are shown as being of substantially rectangular cross-section. It is also convenient, as is shown in FIG. 14, to construct these as at 46 with a similar tapered shape, as is used for the modulator panels. In that case, the side edges of the cushion layers 39, 42 are also beveled to accommodate the taper in the edge panels.

Figure 15:
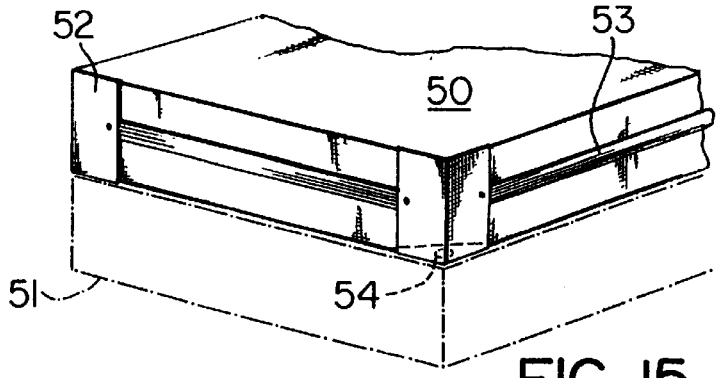
FIGS. 15, 16, and 17 show details of a second cradle construction to those shown in FIGS. 2, 3, and 9.
Figure 16:
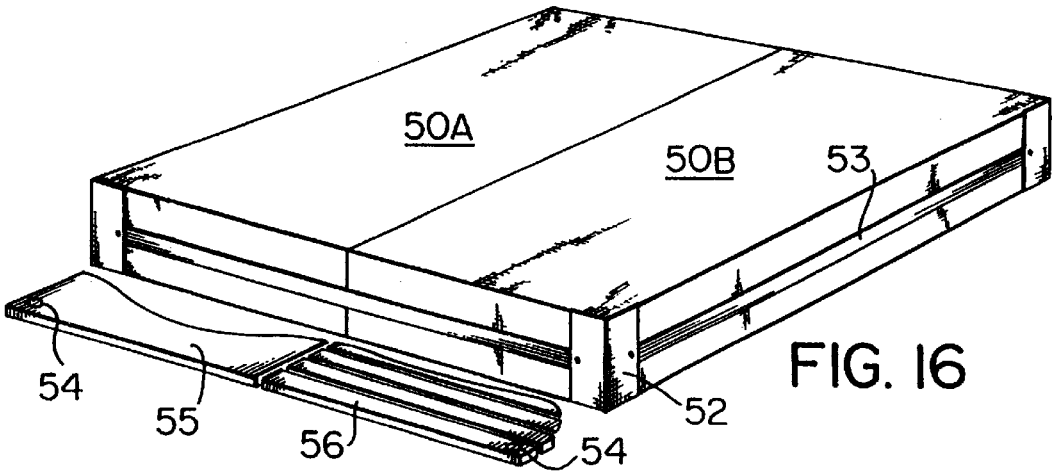
Figure 17:
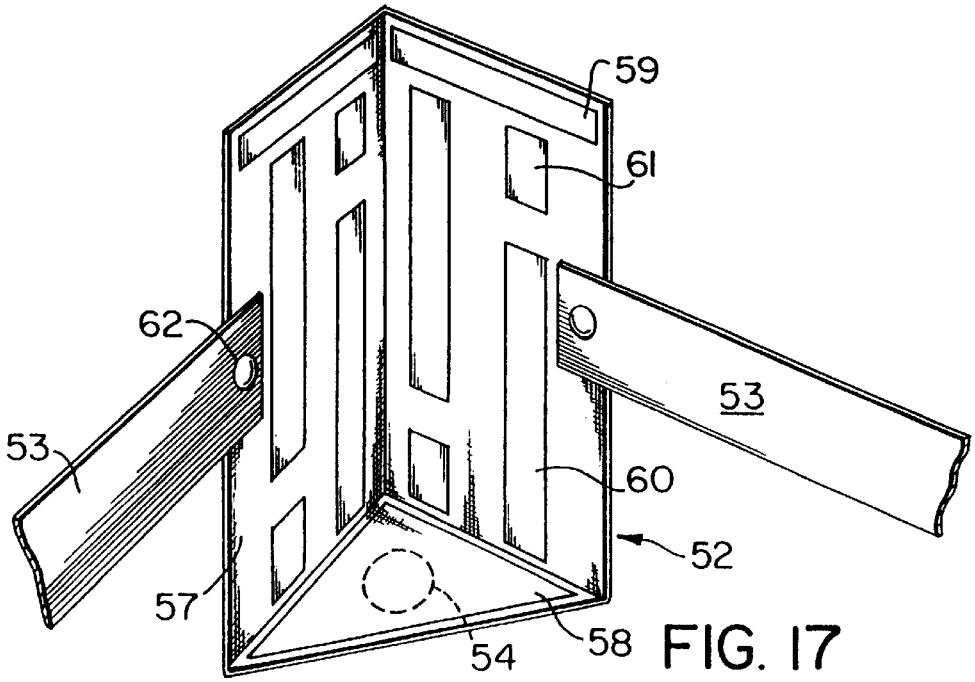

In FIGS. 15, 16 and 17 is shown an alternative form of cradle for either a single bed, as in FIG. 15, or a double bed, as in FIG. 16. Details of the corner construction are shown in FIG. 17. In these Figures, details of the mattress element construction are omitted for clarity. Further, the support options in FIGS. 15 and 16 can be interchanged.

Referring to FIG. 15 first, a mattress shown generally at 50 is supported on an existing conventional box spring, 51. The cradle comprises four corner elements 52, and four linking strap elements 53. The corners, 52, are attached to the box spring 51 by cooperating Velcro patches, as at 59.

FIG. 16 shows a similar arrangement for a double bed with two mattress element sets, 50A and 50B. Four corner elements 52 are connected by four linking strap elements 53, and are attached to the base by the cooperating Velcro units 59. Other fixing means, such as a strap, could also be used. Two options for supporting the mattress are shown; in practice, only one would be used, for the full width of the bed. On the left, as at 55, a one piece relatively thick cradle base is used, such as a sheet of plywood. On the right, as at 56, a sectioned cradle base comprising a plurality of support beams is used. Either of these bases could be used supported by a suitable bed frame.

FIG. 16 shows the corner in more detail. The main body 52 of the corner is made of a stiff, or stiffened, fabric, for example two layers of a decorative fabric with a layer of stiffening bonded therebetween. The bottom angle is strengthened with a plastic insert 58: this face rests on the underlying cradle support. Each vertical part of the corner includes a plurality of horizontal, 59, and vertical, 60, 61, flexible stays. Gaps are provided between these stays so that the corner is flexible, and will bend, for example if the user sits down on the corner of the mattress. The linking strap elements 53 are releasably joined to the corners 52 by fasteners, as at 62, such as a snap. The corners and the lining strap elements are so sized that when the mattress elements are inserted they are placed under slight lateral compression. In order to change the sequence in a mattress set, either the set is removed and replaced, or one of the linking straps is detached, in order to free the set.

Figure 18:
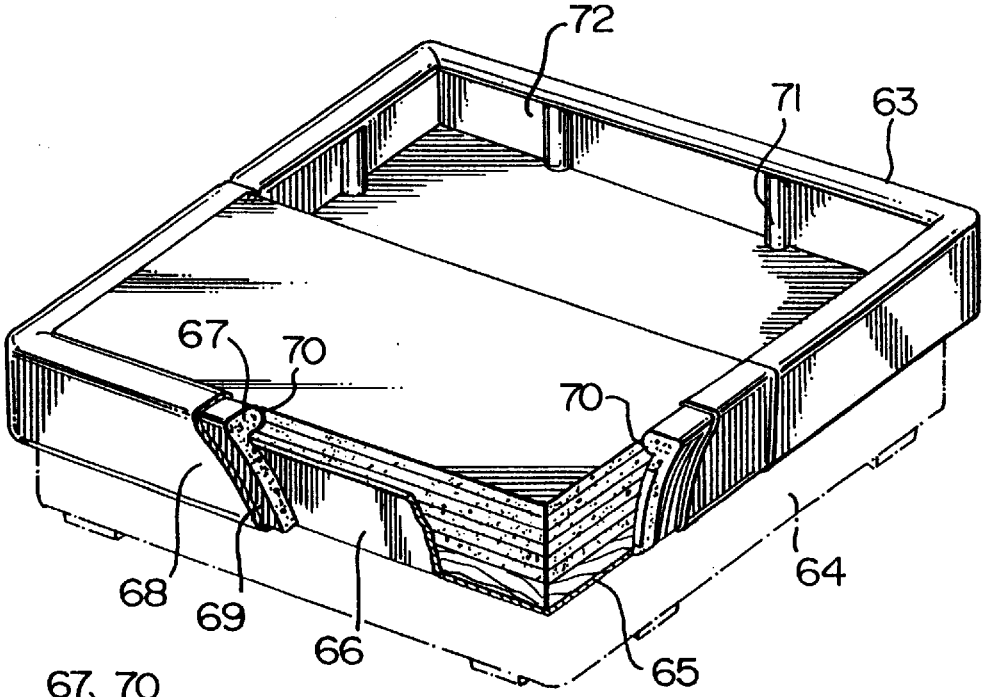
FIGS. 18 and 19 show details of a third cradle construction to those shown in FIGS. 2, 3 and 4.
Figure 19:
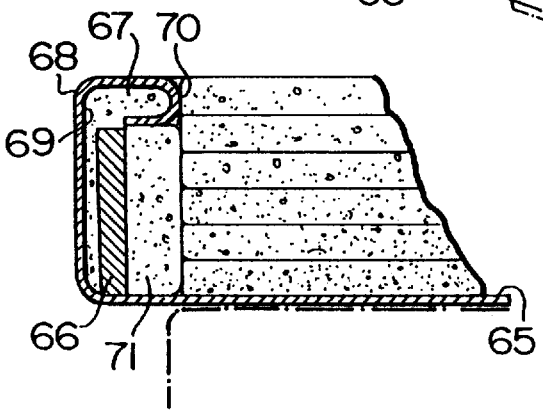
Figure 20:
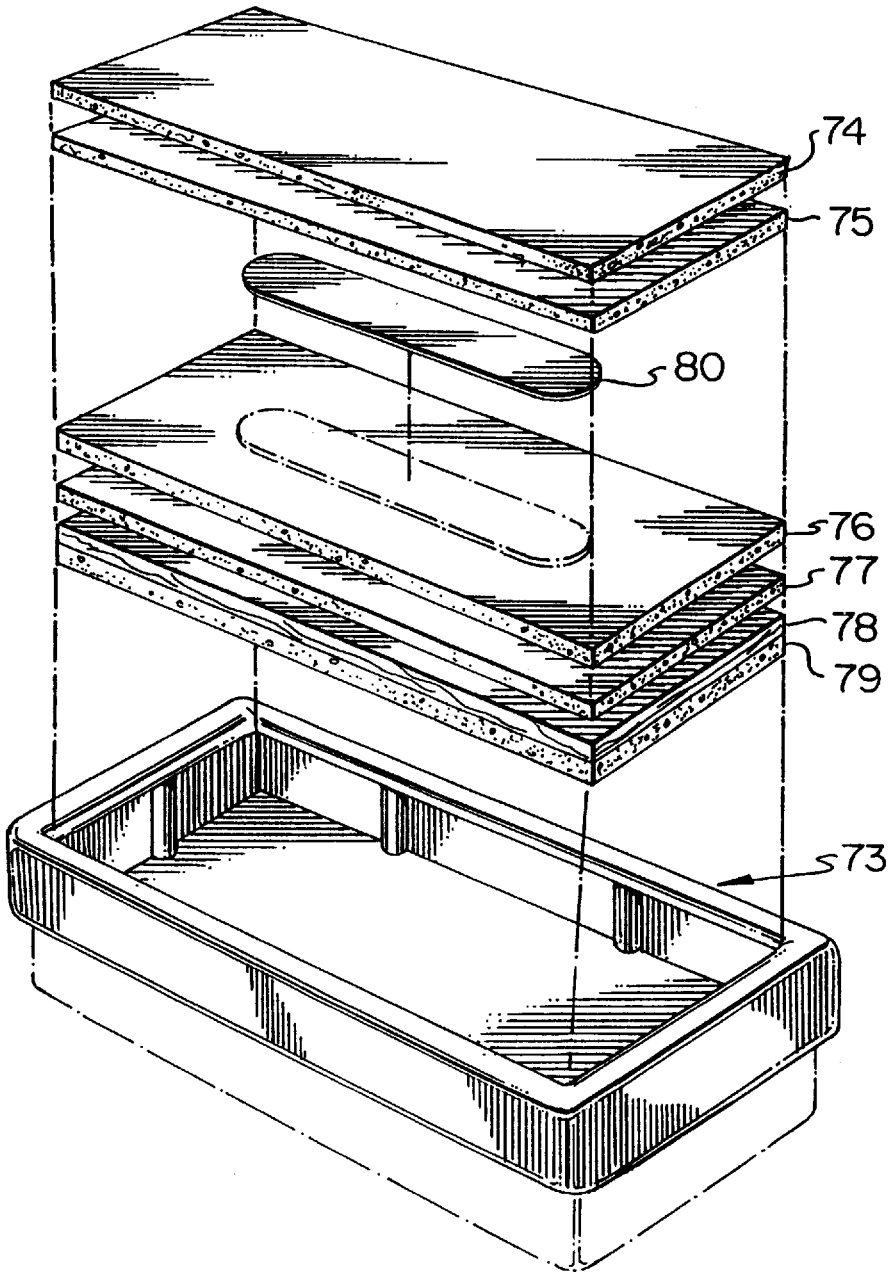
FIG. 20 shows a mattress including a torso board.

In FIGS. 18 and 20 a third form of cradle is shown; FIG. 18 is a double bed, and FIG. 20 is a single bed. The arrangement of the mattress elements within the cradle is shown in FIG. 19, which is a part section on line C—C in FIG. 18. Referring first to FIG. 18, the cradle shown generally at 63 is supported on a support shown schematically at 64. The same considerations apply to the support 64 as have been discussed earlier.

The cradle comprises a base, 65, with an upstanding core 66 around its four edges. Again, the nature of the base chosen will be in large part determined by the nature of the support 64. The outer face of the core is covered with a layer of upholstery foam 67, and then cased in suitable upholstery material 68. A filler layer, 69, may be included as well. The top edge of the foam 67 extends inwardly up above the core 66, on all four sides, to provide an inward facing upholstered upper horizontal lip projection element 70. On the inner face of the core similarly constructed lower vertical lip elements are provided, as at 71. As can be seen from FIG. 19, the lower lip elements project inwardly the same distance as the upper one. These lip assemblies serve three interrelated purposes. First, they provide an upholstered rim all around the bed. Second, they serve to hold the foam mattress elements in place, and to provide the small amount of lateral compression needed, as the space inside them is a little smaller than the foam mattress elements. Third, by being flexible, and by having free spaces as at 72 in between them, space is provided for tucking in bedclothes, such as sheets and blankets.

A cradle of this type can be made as one piece, as shown in FIG. 20 for a single bed, or in two pieces if desired as shown in FIG. 18 for a double bed.

A further problem that can arise for the user of a bed is that it is desirable, on either a short term basis as the result of injury, for example, or on a long term basis, to be able to make one area of a sleeping surface significantly stiffer than the remainder. With a normal mattress this is not easily achieved in any way that is comfortable. As is shown in FIG. 20 this is easily achieved with a mattress according to this invention. Although illustrated in FIG. 20 for a single bed, the same procedure can be used in a double bed, when assembled according to either of FIGS. 2 or 4. Suitable locations are indicated at Y in FIG. 2, and Z in FIG. 4.

In FIG. 20 is shown a single bed using the same form of cradle as is shown in FIG. 18. Inserted into the cradle shown generally at 73 is a set of mattress elements 74, 75, 76, 77, 78, and 79. These mattress elements are all constructed as discussed above, and generally will be of differing firmness and will include a core element. Included in the set of elements is a torso board, 80. As shown it is between elements 75 and 76. If placed higher, as at Y in FIG. 2, a greater degree of firmness is obtained. If placed lower, as at Z in FIG. 4, a lesser degree of firmness is obtained. As shown in FIG. 20, the torso board, unlike the core element, is significantly smaller than the remainder of the elements making up the mattress, and consequently it will provide increased firmness over only a limited area of the mattress. Also as a consequence of the smaller size, it can be located wherever it is needed. Thus unlike the core element the torso board can provide a harder area to support the spine, and yet still leave the remainder of the sleeping area acceptably soft.

The torso board is fabricated from thin light weight material, and generally is not padded like the core element. The torso board may be made of a semi rigid rubber material. It is necessary to ensure that the torso board will remain where it is placed whilst the bed is in use. Hence it is desirable to have at least one relatively non-skid surface. How this is achieved depends on the material used for the torso board. If it is fabricated from a thin stiff fiber board, such as masonite or hardboard, a fabric casing (much the same as those used on the foam mattress elements as described earlier) is convenient. If it is fabricated from a plastic sheet, such as ABS, then no fabric casing appears to be needed. As the torso board is relatively thin, of the order of 5–10 mm, it can be added to an existing mattress without materially affecting the overall thickness. Generally a torso board will be up to about 1.7 m in length, and up to about 1.0 m in width.

It is also contemplated that both a torso board and a rigid core element can be used together. Obviously, the core element would not be placed above the torso board, and likely would not be immediately below it. Thus in FIG. 20 one of the mattress elements 77, 78, or 79 could comprise a core element.

Exactly how the mattress is assembled depends on the desired level of firmness. For a very hard support surface, the core element, such as 17, 27 in FIG. 2, is located on top of the mattress elements within the containment means. To get a softer surface, the core element is moved downward in the stack and one or more mattress elements are placed above it. This allows for a constant sleeping surface height, even in a double bed, with varying levels of firmness between the two sides.

If six mattress elements are available, which may include a rigid core element, each of which is of a different firmness, then there are up to 720 possible combinations for the mattress. It should also be noted that where a plurality of mattress elements are used, the firmness can be varied simply by changing the sequence in which the mattress elements are stacked in the mattress containment means above any base, such as 18 in FIG. 2.

The foam mattress as disclosed herein, and comprising at least a plurality of foam mattress elements, is meant to act as a substitute or a replacement for a conventional mattress. In this sense, it requires a flat substantially rigid base on which to rest. In the absence of a flat substantially rigid surface, the mattress herein described would require at least one bed board to act as the support surface. Thus, the mattress herein described could rest on a conventional box spring or on a frame with at least one bed board thereon. If it is to be used on a frame, then it is convenient to use a construction including a cradle, such as is shown in FIGS. 2, 15, 19, and 20. In that case, the base of the cradle rather than being a relatively light stiff board material, such as masonite, advantageously is constructed to provide a substantially rigid support surface for the mattress elements. A cradle can also be constructed on a box unit, suitably upholstered on its sides, to replace the box spring unit commonly used beneath a conventional mattress. It is thus apparent that the construction of the base part of the cradle is adapted to suit the properties of the surface onto which the mattress unit and cradle will be laid when in use.

As is discussed at some length above, it is very desirable to provide a containment means for a mattress according to this invention. The containment means can be chosen in several ways, in part by the mattress user and in part by the mattress maker. One option is to use a conventional commercial fitted sheet, upon which the user lies, and which is removed for laundering. Such a fitted sheet generally encases both the top, the sides, and a proportion of the underside of the mattress, and is elasticized at the edge in the head and foot areas to keep it in place. It is thus under some overall tension when installed on to a mattress, and therefor exerts a level of lateral compression on the mattress elements.

Alternatively it is convenient to use a mattress pad assembly, either as the containment or in conjunction with a fitted sheet. Commercially available mattress pads are constructed in the same way as a fitted sheet and thus will provide the required lateral pressure on the mattress elements. This method has the advantages that the pad will hold the stack as a coherent assembly whilst the bed sheet is being changed.

In the preceding discussion the mattress elements, and the core element, are referred to as being made from, or incorporate, "foam". This term is well understood in the upholstery art. It is used to refer to foam rubber, but latterly refers to foam materials made from synthetic polymers, including synthetic rubbers and other polymers. In modern practice, polyurethane materials are commonly used. These can be either open cell or closed cell materials. Further, it is also known to control the firmness of a foam material by including deliberate voids within it, and to contour its surface. The voids commonly are deliberately shaped holes, such as cylindrical ones. The use of such procedures is within the concepts of this invention.

Figure 21:
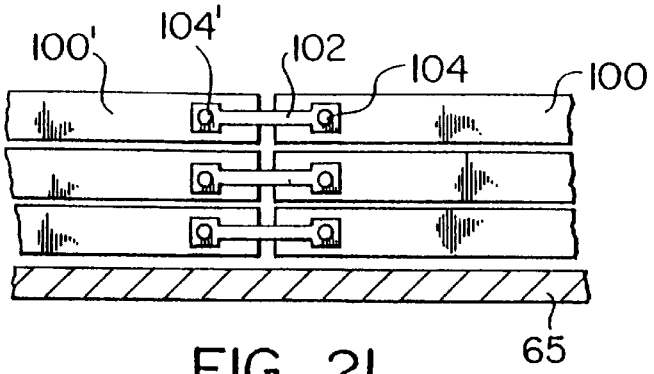
FIG. 21 shows a detailed end view of the attachment straps between two adjacent stacks of mattress elements.

As shown in FIG. 21, the containment means can also be provided by attachment straps 102. The straps 102 interconnect corresponding mattress elements 100 and 100' directly in the embodiment shown. Preferably, the straps 102 are releasably attachable to either mattress element and fasteners 104 and 104' are provided which act between the mattress elements and the straps. Suitable fasteners are snaps, Velcro or even hooks, the latter being more effective when the straps are elastic. As can be appreciated, the centerline gap between the stacks is securely minimized by the use of straps 102. Alternatively, a full height strap could interconnect all mattress elements together.

Figure 22:
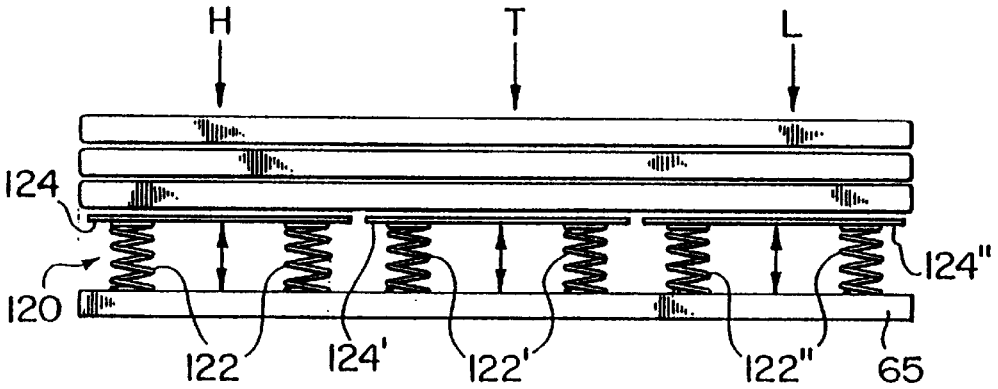
FIG. 22 shows a side view of the sectional spring support base according to the preferred embodiment.

FIG. 22 illustrates a sectional spring base 120 having three vertically mobile panels 124, 124' and 124" which are mounted on springs 122, 122' and 122" respectively. The tension of the springs are selected to provide a suitable resilient base support at the head zone, H, the torso zone, T, and the leg zone, L. The spring base gives a soft and lively feel to the mattress. The section panels 124 may be wholly independent as illustrated or interconnected by hinges or even articulated springs.

Figure 23:
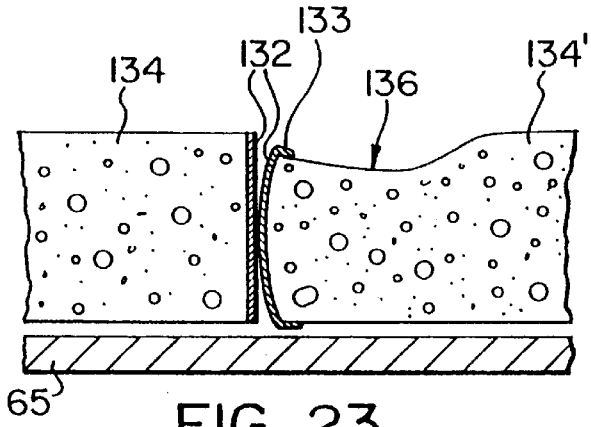
FIG. 23 shows a detailed sectional view of adjacent foam mattresses provided with edge separation means with one mattress undergoing independent compression.

FIG. 23 shows two foam mattresses 134 and 134' arranged side by side and provided with edge separation fabric strips 132. When a pressure is exerted on one mattress 134' in the direction 136, the compression results in movement between the two mattresses at the centerline. Foam to foam contact could result in wear due to friction. The edge separation means also prevents that when the compression is released, the returning movement of mattress 134' has less ability to lift adjacent mattress 134. The strips 132 can be made of fabric, in which case the fabric is preferably glued to the lengthwise edges of both mattresses. If the strip is made of a material having a low coefficient of friction with foam, such as a plastic film, then a single sheet arranged between the mattresses may provide ample separation between the mattresses 134 and 134'.

Figure 24:
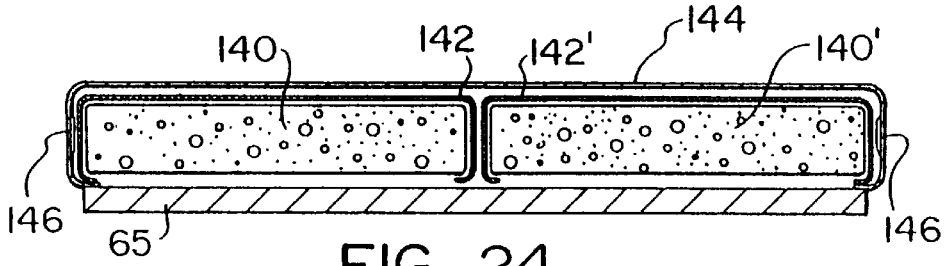
FIG. 24 shows a transverse sectional view of two side by side mattresses provided with single fitted sheets for edge separation means and a single king size fitted sheet over both mattresses as containment means.

As shown in FIG. 24, the edge separation means can also be provided by placing a fitted sheet 142 and 142' around each respective mattress 140 and 140'. To make a single sleeping surface and to contain the mattresses 140 and 140', a larger fitted sheet 144 can be placed around both fitted sheets 142. In the arrangement shown, mattresses 140 are single mattresses which are half of the width of a king mattress. The fitted sheets 142 are standard single bed fitted sheets. The fitted sheet 144 is then a standard king size fitted sheet. The sheet 144 may be store bought with the user's choice of color and pattern. If the same arrangement is applied to a queen size mattress system, the single fitted sheets 142 could be custom made to be of the right size to fit mattresses 140, whose length would be the same as a standard queen bed and whose width would be one half that of a standard queen bed. Then, the user may choose any commercially available fitted queen sheet for sheet 144.

Figure 25:
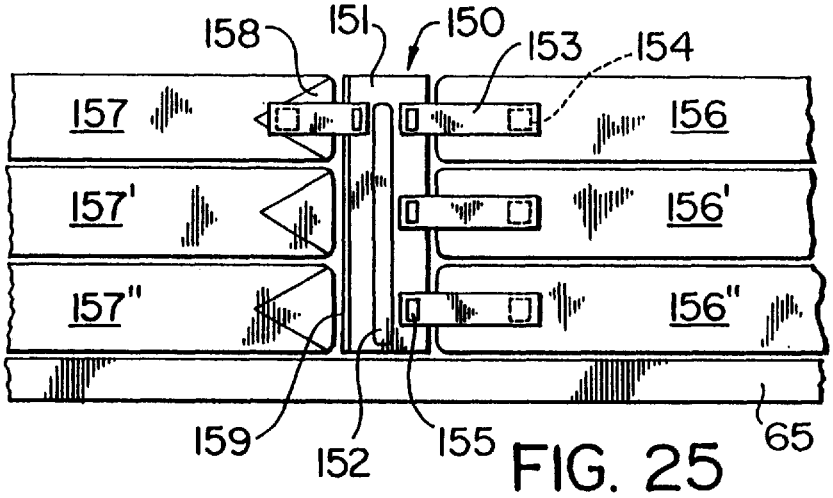
FIG. 25 shows a detailed end view of the movement block located between two stacks of mattress elements, provided with straps connecting the elements to the block.

FIG. 25 shows a detailed end view of the movement block 150. The block 150 helps to reduce deflection transmission sideways across a bed, especially if one user is of significantly different weight to the other. The foam block 151 can absorb small sideways movements of either mattress set 157 or 156. The block 151 includes a semi-rigid core panel 152 for dispersing evenly a sideways movement from one set of mattress elements to the other. As there is vertical movement between the block 151 and the mattress elements 157, 157' and 157", edge separation sheet 159 can be provided on one or preferably both longitudinal sides of block 151. The straps 153 attach the mattress elements 156 and 157 to block 150. Velcro patches 154 are sewn to straps 153 and glued to the mattress elements, such that the elements can easily be interchanged. As shown, mattress elements 157, 157' and 157" can be provided with wedge shaped modulation panels 158 having a firmness selected to give the mattress elements 157 a combined firmness adjacent block 150 substantially equal to a firmness of block 151 including panel 152.

Figure 26:
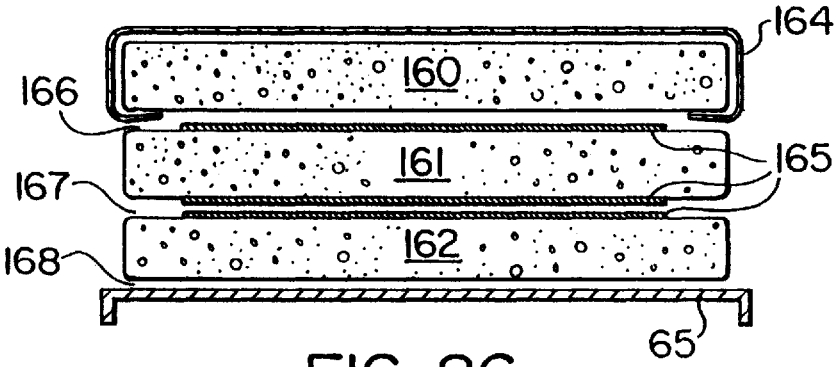
FIG. 26 shows a transverse sectional view of three mattress elements in a vertical stack each having at least partial foam contact between adjacent mattress elements or the support base.

A further aspect of the invention is illustrated in FIG. 26. A stack of mattress elements 160, 161 and 162 having different firmnesses is provided on a base 65. The elements can be rearranged to adjust the firmness of the stack. Separation sheets 165 are provided on central portions of the upper side of mattress element 162 and both sides of mattress element 161. The separation sheets 165 enhance independent compression and flexion of the elements. However, the exposed portions of the elements at 166, 167 and 168 serve an important purpose of allow the high friction or adherence property of the foam to keep the elements 160, 161 and 162 aligned in the vertical stack. While foam to foam contact will provide a high degree of adherence, the force required to contain the elements in a stack need not be so great, and contact between foam and cloth as at 166 where the foam of element 161 contacts fitted sheet 164 is sufficient. Similarly, element 162 has contact surface 168 against base 65 which provides an anti-slip or anti-skid contact. The side edges of the mattress elements are shown bare, however, they may also be covered with a decorative fabric making the stack a complete mattress system when covered by a single fitted sheet 164.

Figure 27:
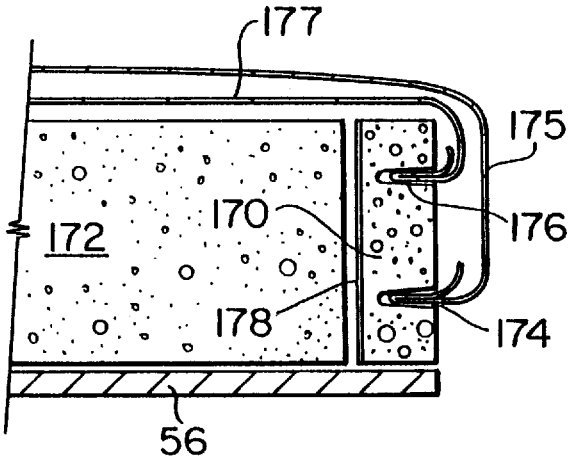
FIG. 27 shows a detailed sectional view of the open top containment means provided with interior edge separation means and exterior slits for receiving a mattress cover and the fitted sheet.

FIG. 27 shows a detailed sectional view of an embodiment of the containment means comprising a surrounding narrow foam piece 170. The piece 170 has a separation sheet 178 for allowing the mattress 172 to compress and flex independently. A first horizontal slit 176 is provided around the containment piece 170 to allow for a mattress cover 177 or "ticking" to be tucked in. A fitted sheet or an ordinary flat sheet 175 is tucked in to lower slit 174. The containment piece 170 may be loosely placed on base 56 in which case blankets can be tucked under piece 170 and mattress 172, or the containment piece may be attached to base 56. If mattress 172 is a stack of mattress elements, the elements can be removed vertically from the containment for rearranging the order of the stack. If mattress 172 is an air mattress, a firm foam containment frame 170 can be advantageous to provide a more solid edge to the mattress when sitting thereon, in addition to the ability to hold a mattress cover and sheet.

Figure 28:
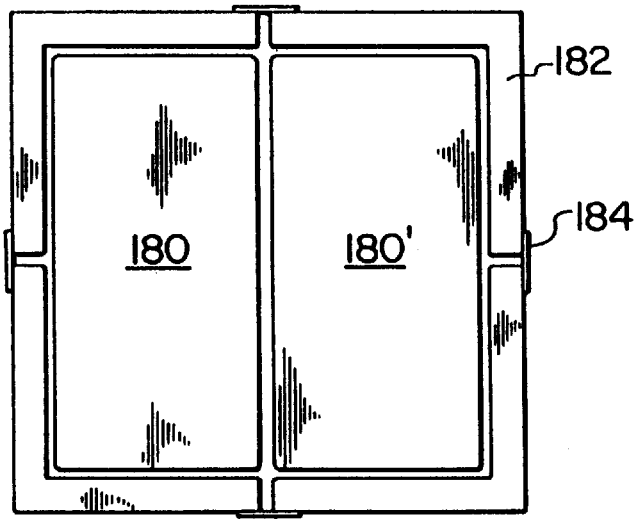
FIG. 28 shows a plan view of two mattresses held together by four L-shaped containment members interconnected at their ends by straps.

FIG. 28 shows a plan view of an embodiment including four L-shaped containment members 182 attached together by straps 184 and containing two mattresses 180 and 180'. The straps may be elastic themselves or may be simply attached under tension and rely on the elasticity of the foam members 182 for containment tension. The elasticity allows the members to snugly fit around mattresses 180 and 180'. The members 182 along with mattresses 180 and 180' can be sized to receive conventional single, double, queen or king size bedding. Alternatively, the elasticity can make it easier to hold bedding tucked in. The straps 184 can be undone to make it easier to insert bedding or to loosen contact between frame members 182 and the mattress elements 180 for rearranging. The mattresses can be single slab mattresses with different firmnesses between sides or multi-layer mattresses having a plurality of rearrangeable stacked mattress elements. It is also possible with any of the side by side mattress arrangements according to the present invention to exchange on one side a foam mattress for a different kind of mattress, such as coil spring, air, water or futon. The containment means, edge separation means, movement block or modulator panel of the foam side will all serve their usual function.

I claim:

1. A multi-layer mattress comprising:

at least two foam mattress elements each having a horizontal contact surface including exposed foam; and separation means for reducing friction between said exposed foam of said foam mattress elements during relative horizontal movement of said contact surfaces when said foam mattress elements are subjected to compression and for permitting each of said mattress elements to compress and flex separately when stacked one above the other and subjected to use.

2. The mattress according to claim 1, further comprising at least one substantially rigid core element of substantially the same length and width as at least one of said mattress elements.

3. The mattress according to claim 2, further comprising a containment means adapted and constructed to ensure that said mattress elements remain situated in their chosen order in a substantially vertical stack, and to subject said mattress elements to slight lateral compression.

4. The mattress according to claim 1, further comprising a substantially stiff torso board, smaller in width and length than at least one of said mattress elements, whereby an overall firmness quality of said mattress can be changed by positioning said board at different levels.

5. The mattress according to claim 4, wherein said torso board is made of rubber.

6. The mattress according to claim 5, further comprising at least one surface element on the torso board constructed and adapted to retain the torso board in a chosen position in between two adjacent ones of said mattress elements.

7. The mattress according to claim 6, further comprising a containment means adapted and constructed to ensure that said mattress elements remain situated in their chosen order in a substantially vertical stack, and to subject said mattress elements to slight lateral compression.

8. The mattress according to claim 4, further comprising a containment means adapted and constructed to ensure that said mattress elements remain situated in their chosen order in a substantially vertical stack, and to subject said mattress elements to slight lateral compression.

9. The mattress according to claim 1, further comprising a containment means adapted and constructed to ensure that said mattress elements remain situated in their chosen order in a substantially vertical stack, and to subject said mattress elements to slight lateral compression.

10. The mattress according to claim 6, wherein the containment means comprises at least one standard fitted sheet, said stack having a height substantially equal to a height of a standard mattress normally receiving said standard fitted sheet.

11. The mattress according to claim 1, comprising two sets of said mattress elements, each of which being of the same length, width and thickness, and at least one further mattress element, said at least one further element being substantially twice as wide as the others, said mattress elements forming two side by side vertical stacks with said at least one further element spanning between said stacks, whereby a two-person bed is formed in which said at least two mattress elements can be interchanged between said two sets.

12. The mattress according to claim 11, wherein said containment means comprise attachment straps provided at a head and foot portions of at least some of said mattress elements for connecting said two stacks together.

13. The mattress according to claim 1, comprising at least three said mattress elements each of which having a different hardness from the others, whereby by rearranging an order of said elements in said stack, more than two different hardness states of said mattress can be obtained.

14. The mattress according to claim 1, wherein the separation means comprises a sheet of fabric attached to one side of each said mattress element.

15. The mattress according to claim 10, wherein the separation means comprises a sheet of fabric attached to both sides of each said mattress element.

16. The mattress according to claim 1, wherein the separation means comprises a fabric casing around each said mattress element.

17. The mattress according to claim 1, further comprising a sectional spring base having at least three vertically mobile, resilient, substantially horizontal panels supporting different zones of said mattress with different resilient support characteristics.

18. The mattress according to claim 1, comprising two sets of said mattress elements, each of which being of the same length, width and thickness, said mattress elements forming two side by side vertical stacks; and edge separation means permitting laterally abutting mattress elements to move vertically more freely.

19. The mattress according to claim 18, further comprising a containment means adapted and constructed to ensure that said mattress elements remain situated in their chosen order in a substantially vertical stack, and to subject said mattress elements to slight lateral compression.

* * * * *